US009533791B2

(12) United States Patent
Fath

(10) Patent No.: US 9,533,791 B2
(45) Date of Patent: Jan. 3, 2017

(54) ACCESSORY PACKAGING

(71) Applicant: Altria Client Services Inc., Richmond, VA (US)

(72) Inventor: Scott A. Fath, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days.

(21) Appl. No.: 13/843,028

(22) Filed: Mar. 15, 2013

(65) Prior Publication Data

US 2014/0262931 A1 Sep. 18, 2014

(51) Int. Cl.

| | |
|---|---|
| ***B65D 5/66*** | (2006.01) |
| ***B65D 5/50*** | (2006.01) |
| ***B65D 5/42*** | (2006.01) |
| ***B65D 5/26*** | (2006.01) |
| ***B65D 5/28*** | (2006.01) |

(52) U.S. Cl.

CPC ..... *B65D 5/425* (2013.01); *B65D 5/26* (2013.01); *B65D 5/28* (2013.01); *B65D 5/509* (2013.01); *B65D 5/5021* (2013.01); *B65D 5/6661* (2013.01); *B65D 5/6667* (2013.01)

(58) Field of Classification Search

USPC ..... 206/486, 549, 545; 229/120.14, 120.08, 229/160, 904, 149, 150, 159

See application file for complete search history.

(56) References Cited

U.S. PATENT DOCUMENTS 1,228,714 A * 6/1917 Stortz ..... 206/756
1,486,145 A * 3/1924 Johnson ..... 206/486
1,824,927 A * 9/1931 Powell ..... 229/150
2,137,420 A * 11/1938 Soybel ..... B65D 5/5021 206/45.29
2,285,991 A * 6/1942 Sidney ..... 206/773
2,303,264 A 11/1942 Flick (Continued)

FOREIGN PATENT DOCUMENTS

FR 2 894 938 A1 6/2007
RU 2197417 C2 1/2003

(Continued)

OTHER PUBLICATIONS

International Search Report and Written Opinion dated Jul. 22, 2014 issued in corresponding International Patent Application No. PCT/US2014/025421.

(Continued)

*Primary Examiner* — J. Gregory Pickett
*Assistant Examiner* — Gideon Weinerth
(74) *Attorney, Agent, or Firm* — Harness, Dickey & Pierce, P.L.C.

(57) ABSTRACT

A self-locking display box is disclosed, which is configured to receive one or more electrical components, wherein the box is erected from a blank having a deck panel having a pair of tabs, which are configured to fit within a corresponding notch of a back panel and which snaps into place to form a rectangular box. The back panel has an upper flap panel and a lower flap panel, the upper flap panel and the lower flap panel each having the corresponding notch therein. The deck panel has a pair of tabs, which extend outward from an upper edge and a lower edge of the deck panel, respectively, and are configured to be received within the corresponding notches of the upper flap panel and the lower flap panel upon assembly of the box.

20 Claims, 12 Drawing Sheets

(56) References Cited

U.S. PATENT DOCUMENTS 2,522,049 A * 9/1950 Lang ..... 229/147
2,536,990 A * 1/1951 Williamson ..... B65D 5/20 206/18
2,672,274 A * 3/1954 Crane ..... 229/159
2,833,458 A * 5/1958 Toensmeier ..... 206/562
2,924,371 A * 2/1960 Frankenstein ..... 206/776
3,023,945 A * 3/1962 Layne, Sr. ..... 229/102
3,089,631 A * 5/1963 Tyrseck et al. ..... 206/490
3,095,086 A 6/1963 Berg
3,146,934 A * 9/1964 Steiger ..... 229/154
3,401,865 A * 9/1968 Holstrom ..... B65D 5/08 206/773
3,581,976 A * 6/1971 Burgess ..... 229/148
3,826,420 A * 7/1974 Bamburg et al. ..... 229/102
3,899,119 A * 8/1975 Roccaforte ..... 206/562
3,949,931 A * 4/1976 Hall ..... 229/102
4,265,393 A * 5/1981 Orchard ..... 229/103.3
4,284,193 A * 8/1981 Roccaforte ..... 206/773
4,572,423 A * 2/1986 Spencer ..... 206/562
4,705,173 A * 11/1987 Forbes, Jr. ..... 206/563
4,754,880 A * 7/1988 Tehrani ..... 206/723
4,773,542 A * 9/1988 Schillinger ..... B65D 5/4266 229/145
4,778,055 A * 10/1988 Kiedaisch ..... 206/563
5,222,657 A * 6/1993 Holland, Jr. ..... A63F 3/00895 206/459.5
5,297,727 A * 3/1994 Brioux ..... B65D 5/5415 229/145
5,407,076 A * 4/1995 Sabet ..... 206/581
5,474,231 A * 12/1995 Froom ..... 229/132
6,085,969 A * 7/2000 Burgoyne ..... B65D 71/36 206/427
6,568,586 B1 * 5/2003 VanEsley et al. ..... 229/120.18
7,007,837 B2 * 3/2006 Correll ..... 229/120.05
7,264,123 B2 * 9/2007 Reed ..... 206/765
7,293,695 B2 * 11/2007 Stier ..... 229/120.14
7,317,573 B2 * 1/2008 Billen ..... B65D 5/10 206/557
7,392,904 B1 * 7/2008 Jackson ..... B65D 25/24 206/423
7,874,430 B2 * 1/2011 Anderson et al. ..... 206/733
8,272,509 B1 * 9/2012 McCutchen ..... 206/486
8,770,466 B1 * 7/2014 Terlesky ..... B65D 5/48018 229/120
8,783,549 B2 * 7/2014 Jo ..... 229/117.08
8,807,338 B2 * 8/2014 Moring et al. ..... 206/459.5
2003/0102244 A1 6/2003 Sanders, Jr.
2004/0178253 A1 * 9/2004 Stier ..... B65D 5/10 229/120.14
2004/0222109 A1 * 11/2004 Pucillo ..... B65D 5/2057 206/216
2005/0051612 A1 * 3/2005 Jouppi ..... B65D 5/10 229/158
2013/0186949 A1 * 7/2013 Fath ..... 229/123.1

FOREIGN PATENT DOCUMENTS

RU 2261207 C2 9/2005
RU 2533112 C2 11/2014
WO 03/076280 A1 9/2003

OTHER PUBLICATIONS

Notification Concerning International Preliminary Report on Patentability dated Sep. 24, 2015 issued in International Patent Application No. PCT/US2014/025421.

* cited by examiner

FIG. 8
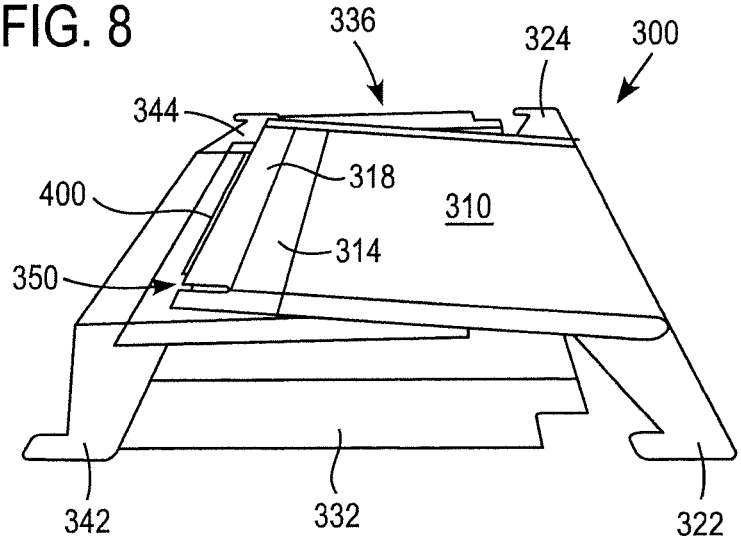
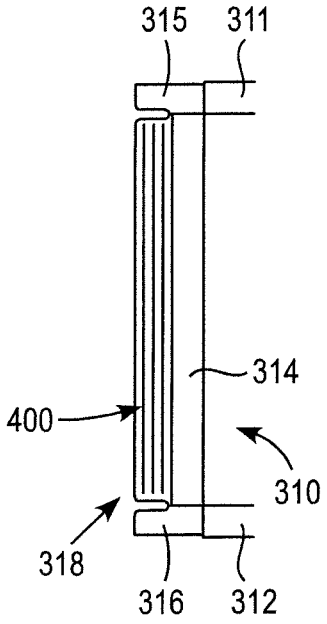
FIG. 9

ACCESSORY PACKAGING

Electronic cigarettes emulate tobacco cigarettes, but without the combustion of tobacco during use. Rather than burning tobacco, a fluid is atomized within the electronic cigarette, which emulates the smoke produced in a tobacco cigarette. The fluid may contain flavoring agents such as tobacco flavor, menthol, and others, to enhance the "smoking" experience of the electronic cigarette. Electronic cigarettes produce atomized vapor using electric power. The electric power can be a rechargeable power source within each electronic cigarette.

Since the rechargeable power source is depleted during operation, the power source must be recharged from time to time using a power adapter to input power to recharge the electronic cigarette. Power adapters can be driven by a power supply, for example, a wall-plug transformer, or through an intermediary device that provides the transformer function. Accordingly, it would be desirable to have a self-locking display box or presentation packaging, which houses one or more power adapters, which uses little or no glue, adhesives, and/or tape.

SUMMARY

In accordance with an exemplary embodiment, a blank for forming a display box comprises: a front panel; an right side panel connected along a vertical fold line to the front panel; a back panel having an upper flap panel and a lower flap panel, the upper flap panel and the lower flap panel each having a notch therein, and wherein the back panel is connected along a vertical fold line to the right side panel; an left side panel connected along a vertical fold line to the back panel; and a deck panel connected along a vertical fold line to the left side panel, the deck panel having a plurality of fold lines, which forms a tray panel having one or more cutouts, an upper deck flap, a lower deck flap, an inner side deck panel, and an outer side deck panel, wherein the deck panel has a pair of tabs, which extend outward from an upper edge and a lower edge of the deck panel, respectively, and are configured to be received within the corresponding notches of the upper flap panel and the lower flap panel upon assembly of the box.

In accordance with another exemplary embodiment, a self-locking display box configured to receive one or more electrical components, wherein the box is erected from a blank having a deck panel having a pair of tabs, which are configured to fit within a corresponding notch of a back panel and which snaps into place to form a rectangular box.

In accordance with a further exemplary embodiment, a method of forming a display box comprises: providing a blank, the blank comprising: a front panel; an right side panel connected along a vertical fold line to the front panel; a back panel having an upper flap panel and a lower flap panel, the back panel connected along a vertical fold line to the right side panel; an left side panel connected along a vertical fold line to the back panel; and a deck panel connected along a vertical fold line to the left side panel, the deck panel having a plurality of fold lines, which forms a tray panel having one or more cutouts, an upper deck flap, a lower deck flap, an inner side deck panel, and an outer side deck panel, wherein the deck panel has a pair of tabs, which extend outward from an upper edge and a lower edge of the deck panel, respectively; folding the deck panel onto the back panel; folding the front panel onto the deck panel; and locking into place, the pair of tabs within a notch within the upper flap panel and the lower flap panel of the back panel.

BRIEF DESCRIPTION OF THE DRAWING FIGURES

The disclosure is explained below with reference to the exemplary embodiments shown in the drawings. In the drawings:

FIG. 8 is a perspective view of the blank for a display box as shown in FIG. 6 in a partially folded state in accordance with an exemplary embodiment;

FIG. 9 is a plan view of an adhesive panel of the blank for a display box as shown in FIG. 6 in accordance with an exemplary embodiment;

DETAILED DESCRIPTION

Figure 1:
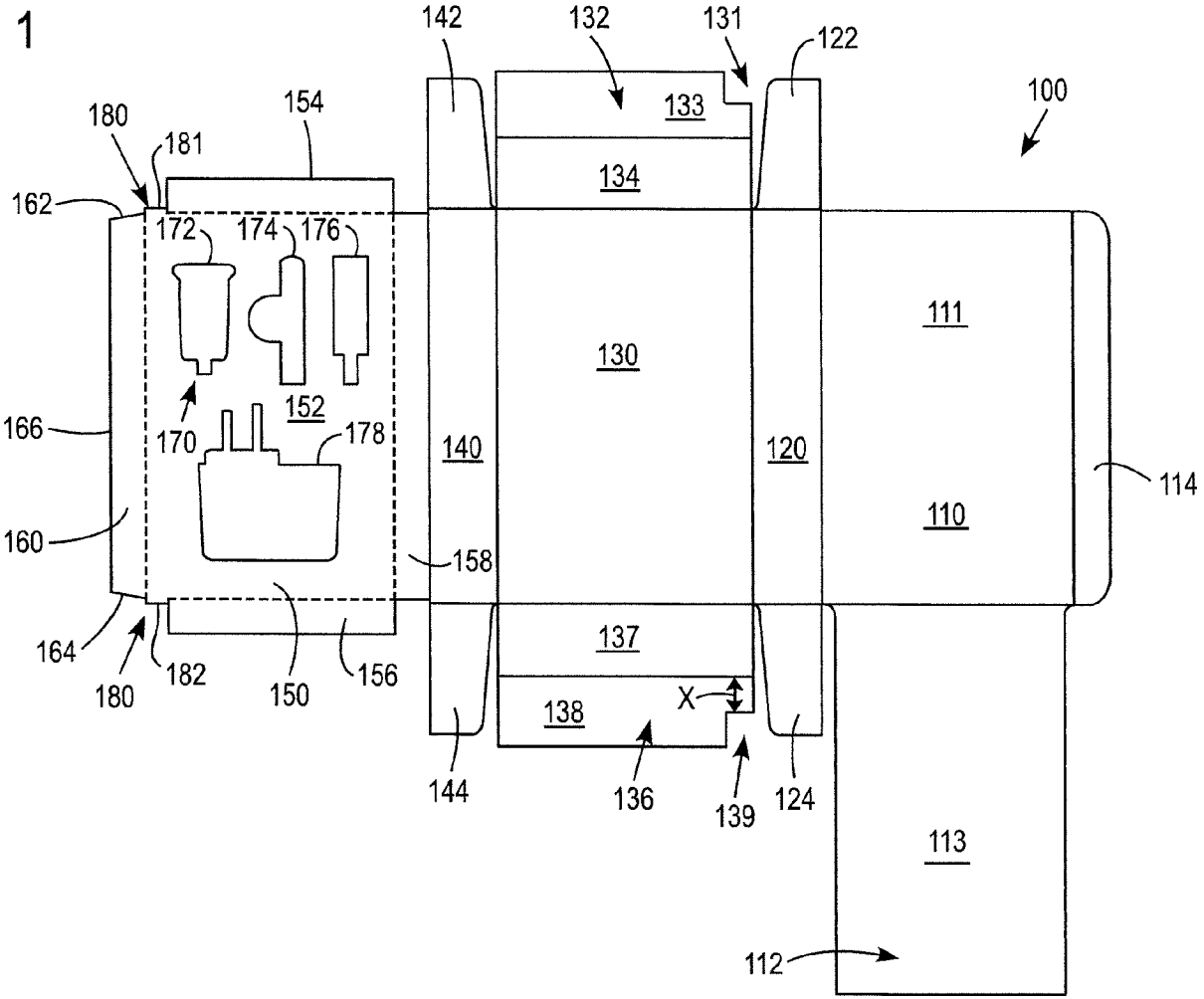
FIG. 1 is a plan view of a clay-side (printable side) of a blank for a display box in a spread out (unfolded) state in accordance with an exemplary embodiment.

FIG. 1 is a plan view of a blank 100 for a display box 200 (FIGS. 6A and 6B) in a spread out state in accordance with an exemplary embodiment. The plan view of the blank 100 as shown in FIG. 1 is a view of a printable side or clay-side of the blank 100. In accordance with an exemplary embodiment, upon assembly of the blank 100 as shown in FIG. 1, the display box forms a rectangular box or substantially rectangular parallelepipedal in shape, with right-angled longitudinal and right-angled transverse edges. The blank 100 includes a front panel 110, a right side panel 120, a back panel 130, a left side panel 140, and a deck panel 150. The right side panel 120 is connected along a vertical fold line to the front panel 110. The back panel 130 can have an upper flap panel 132 and a lower flap panel 136 connected along a vertical fold line to the right panel 120. The left side panel 140 is connected along a vertical fold line to the back panel 130. The deck panel 150 is connected along a vertical fold line to the left side panel 140.

In accordance with an exemplary embodiment, an outer front panel flap 114 connected along a vertical fold line to the front panel 110 along a bottom side portion of the front panel 110, although a front panel flap 112 could be arranged along a bottom side portion of the front panel 110. A right upper dust flap 122 and a right lower dust flap 124 are each connected along a corresponding horizontal fold line to the right side panel 120. A left upper dust flap 142 and a left lower dust flap 144 are each connected along a corresponding horizontal fold line to the left side panel 140. The upper flap panel 132 has an upper fold line, which divides the upper flap panel 132 into a first upper flap panel 133 and a second upper flap panel 134. The lower flap panel 136 has a lower fold line, which divides the lower flap panel 136 into a first lower flap panel 137 and a second lower flap panel 138.

In accordance with an exemplary embodiment, the right upper dust flap 122 and the right lower dust flap 124 have a generally rectangular shape thereto which includes a pair of outer edges, which can be angled and/or vertical. In accordance with an exemplary embodiment, the angled edge of the upper dust flap 122 and the lower dust flap 124, which face the back panel 130 can have a slightly rounded corner thereto, which produces a base portion, which is connected along a horizontal fold line to the right side panel 120 having a greater length than the outer horizontal free edge on an outer portion thereof.

In accordance with an exemplary embodiment, the left upper dust flap 142 and the left lower dust flap 144 have a generally rectangular shape thereto, which includes a pair of outer edges, which can be angled and/or vertical. In accordance with an exemplary embodiment, the angled edge of the left upper dust flap 142 and the left lower dust flap 144 have a slightly rounded corner thereto, which produces a base portion, which is connected along a horizontal fold line to the left side panel 140 having a greater length than the outer horizontal free edge on an outer portion thereof.

In accordance with an exemplary embodiment, the deck panel 150 has a plurality of fold lines (or scores lines), which divides the deck panel into a tray panel 152, an upper deck flap 154, a lower deck flap 156, an inner side deck panel 158, and an outer side deck panel 160. The tray panel 152 can include one or more cutouts 170. In accordance with an exemplary embodiment, the transition from the upper deck flap 154 and the lower deck flap 156 to the outer side deck panel 160 includes a pair of tabs 180, which extend outward from an upper edge 181 and a lower edge 182 of the deck panel 150, respectively. In accordance with an exemplary embodiment, the one or more cutouts 170 can be configured, for example, in the shape of a car charger 172, a battery 174, a USB charger 176, and/or a wall charger 178.

In accordance with an exemplary embodiment, the front panel 110, the front panel flap 112, and the deck panel 150 are printable surfaces. For example, in accordance with an exemplary embodiment, the tray panel 152 of the deck panel can be a printable surface, which identifies corresponding components, which fit within the one or more cutouts 170. In accordance with another exemplary embodiment, the second lower flap panel 138 is a printable surface. For example, the printable surfaces can include a printable clay coat.

In accordance with an exemplary embodiment, the front panel 110 has a height of about 170 mm (6.693 inches) and a width of about 110 mm (4.331 inches). The right side panel 120 has a height of about 170 mm (6.693 inches) and a width of about 30 mm (1.181 inches). The back panel 130 has a height of about 170 mm (6.693 inches) and a width of about 110 mm (4.331 inches). The upper flap panel 132 and a lower flap panel 136 each have a height of about 59.5 mm (2.343 inches) and a width of about 110 mm (4.331 inches). The left side panel 140 has a height of about 170 mm (6.693 inches) and a width of about 30 mm (1.181 inches).

In accordance with an exemplary embodiment, an outer front panel flap 114, which is connected along a vertical fold line to the front panel 110 has a height of about 168 to 170 mm (6.614 and 6.693 inches) and a width of about 15 mm (0.591 inches). The front panel flap 112 has a height of about 161 mm (6.457 inches) and a width of about 110 mm (4.331 inches). The right upper dust flap 122 and the right lower dust flap 124 each have a height of about 54.5 (2.146 inches) and a width of about 30 mm (1.181 inches). In accordance with another exemplary embodiment, the left upper dust flap 142 and the left lower dust flap 144 each have a height of about 54.5 (2.146 inches) and a width of about 30 mm (1.181 inches).

The first upper flap panel 133 has a height of about 29.0 mm (1.142 inches) and a width of about 110 mm (4.331 inches). The second upper flap panel 134 has a height of about 30.5 mm (1.201 inches) and a width of about 110 mm (4.331 inches). The first lower flap panel 137 has a height of about 30.5 mm (1.201 inches) and a width of about 110 mm (4.331 inches). The second lower flap panel 138 has a height of about 29.0 mm (1.142 inches) and a width of about 110 mm (4.331 inches). In accordance with an exemplary embodiment, an outer corner of each of the first upper flap panel 133 and the second lower flap panel 138 has a notch (or cut-out) 131, 139 on the outer edge, which is configured to each receive one of the pair of locking edges 180 when the display box 200 is assembled. For example, in accordance with an exemplary embodiment, the notch 131, 139 on the outer edge has a height of about 14.0 mm (0.561 inches) and a width of about 12.0 mm (0.472 inches). The former (height) dimension is selected to match the desired, predetermined space between the underside of the tray panel 152 and back panel 130 upon erection of the display box 200, whatever that spacing is selected to be.

Figure 5:
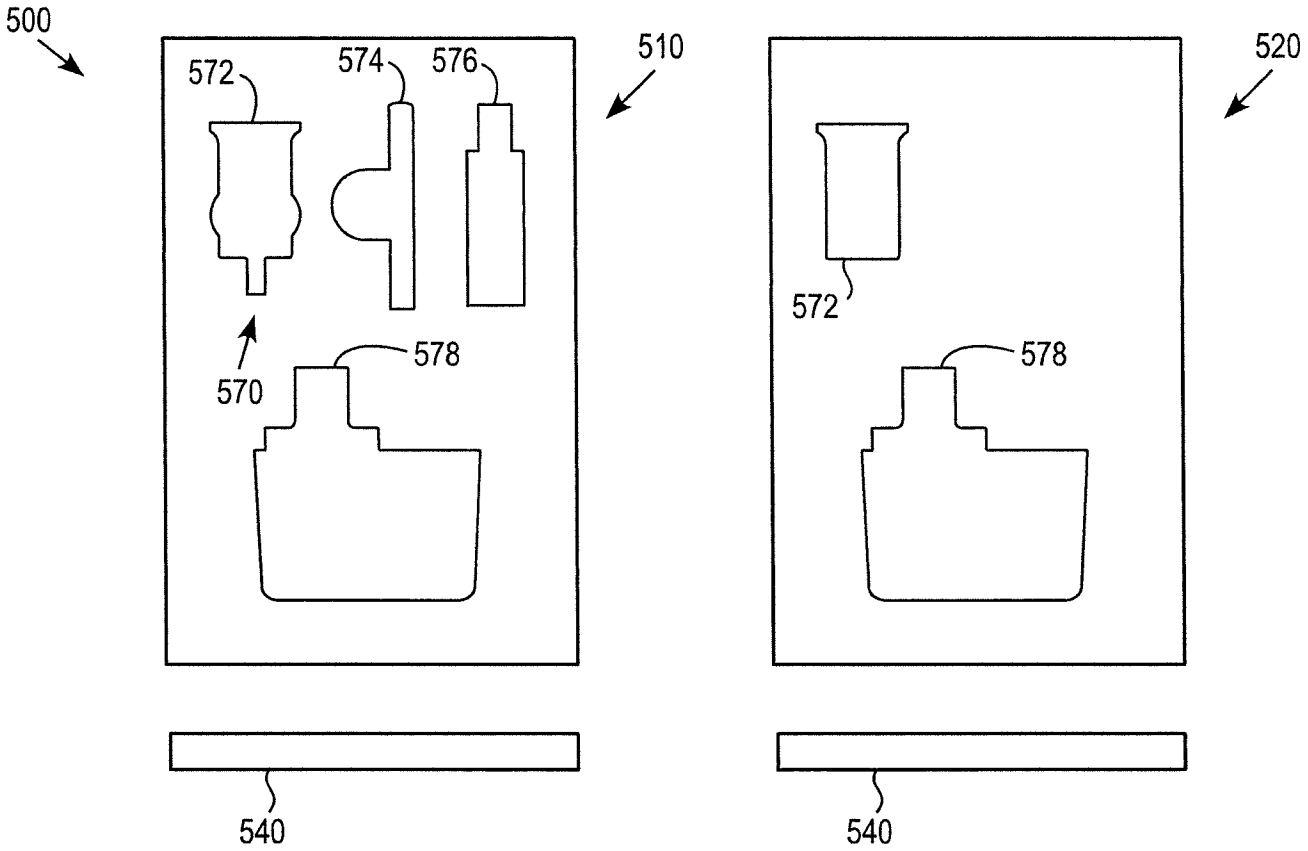
FIG. 5 is a plan view of a top foam retention panel and a bottom foam retention panel for a display box in accordance with an exemplary embodiment.

In accordance with an exemplary embodiment, the distance (x), as shown in FIG. 1, which is the distance from the fold lines between panels 137 and 138 and the notch, determines the spacing (or height) at which the display panel 152 is spaced apart from the back panel 130. Preferably, the height is selected such that the display panel 152 contacts the foam inserts, preferably, the display panel 152 bears against the foam inserts 500 (FIG. 5).

In accordance with an exemplary embodiment, the tray panel 152 has a height of about 194 mm (7.638 inches) and a width of about 137 mm (5.394 inches). The upper and lower deck flaps 154, 156 have a height of about 14.0 mm (0.561 inches) and a width of about 108 mm (4.252 inches). The inner side deck panel 158 has a height of about 166 mm (6.535 inches) and a width of about 15 mm (0.591 inches). The outer side deck panel 160 has a height of about 166 mm (6.535 inches) and a width of about 14 mm (0.561 inches). In accordance with an exemplary embodiment, a lower edge 162 and an upper edge 164 of the outer side deck panel 160 is angled at about 15 to 60 degrees to a free, transversely extending vertical outer edge 166 of the outer side deck panel 160.

Figure 2:
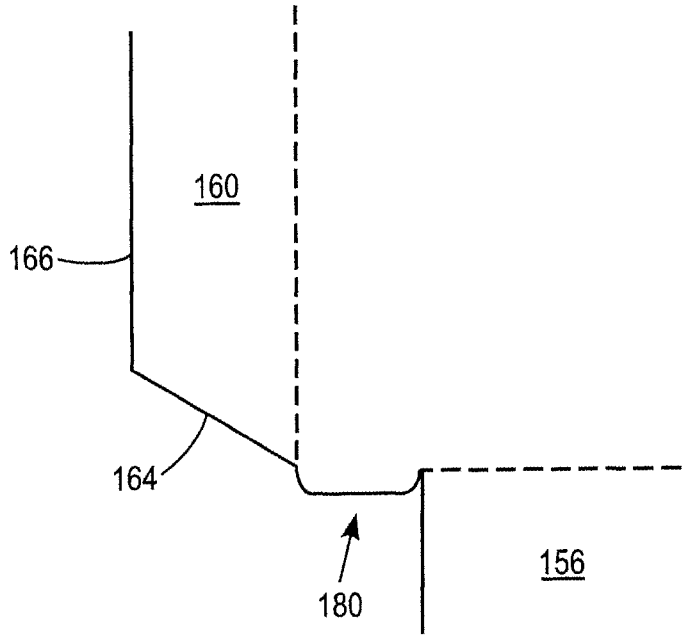
FIG. 2 is a plan view of a tab or locking edge of the blank for a display box as shown in FIG. 1 in accordance with an exemplary embodiment.

FIG. 2 is a plan view of a tab or locking edge 180 of the blank 100 for a display box as shown in FIG. 1 in accordance with an exemplary embodiment. As shown in FIG. 1, the deck panel 150 comprises a tray panel 152 having a pair of tabs or locking edges or tabs 180, each of which extends transversely outwardly from the right edge 181 and the left edge 182 of the deck panel 150, respectively. Preferably, the tabs 180 have rounded corners to minimize the possibility of snagging and fraying. It is preferred to position the tabs 180 proximate to the fold lines of panels 156 and 180 to provide strength and rigidity.

Figure 3:
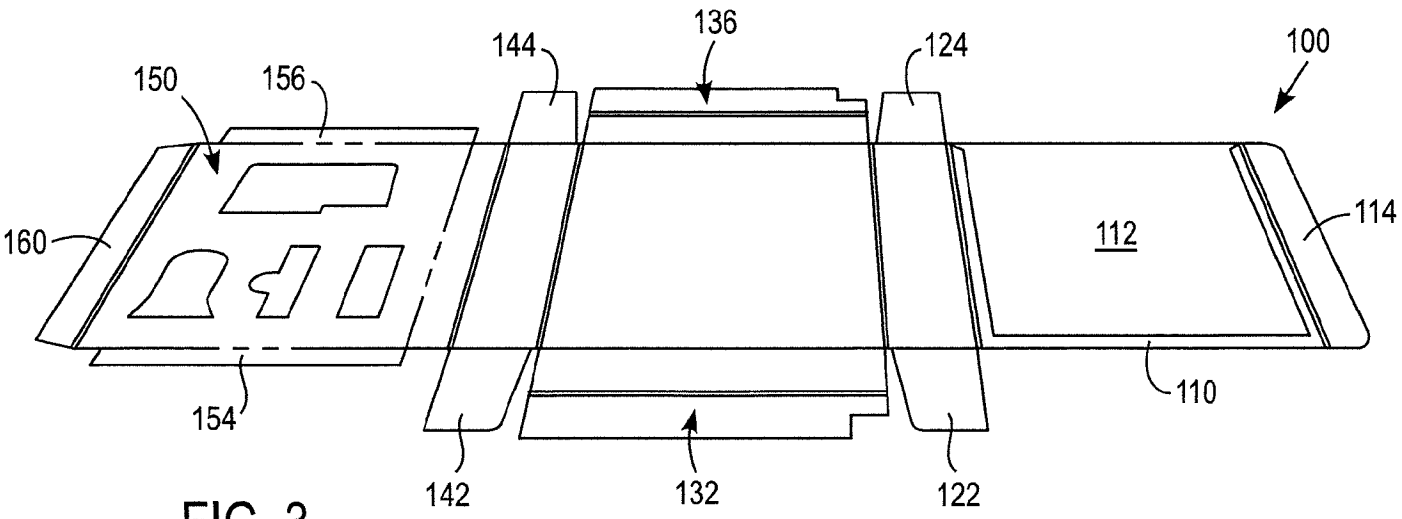
FIG. 3 is a perspective view of the blank for a display box as shown in FIG. 1 in accordance with an exemplary embodiment.

FIG. 3 is a perspective view of the blank 100 for a display box 200 as shown in FIG. 1 in accordance with an exemplary embodiment, wherein the front panel flap 112 has been folded 180 degrees onto the front panel 110. The printable clay side of the front panel 112 is presented in FIG. 3. In accordance with an exemplary embodiment, the display box 200 is assembled by applying an adhesive to an inner or backside (non-clay) surface 111 (FIG. 1) of the front panel 110 and an inner non-clay surface 113 of the front panel flap 112 and folding the front panel flap 112 along the fold line (or score line) onto the front panel 110. The adhesive can be glue spots, glue lines, a glue pattern, a double sided sticker, or other suitable adhesive for assembling a box 100 as described herein.

Figure 4:
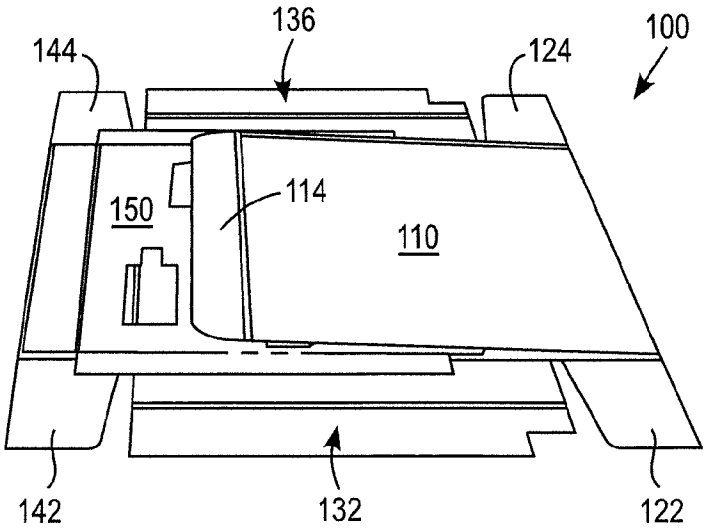
FIG. 4 is a perspective view of the blank for a display box as shown in FIGS. 1 and 2 in accordance with an exemplary embodiment.

FIG. 4 is a perspective view of the blank 100 for a display box as shown in FIGS. 1 and 2 in a partially folded state in accordance with an exemplary embodiment. As shown in FIG. 4, in accordance with an exemplary embodiment, by folding the front panel flap 112 onto the front panel 110, the display box 200 has a reinforced lid having a thickness, which is about two times that of the other panels of the display box 200. The deck panel 150 and the left side panel 140 are then folded 180 degrees about the fold lines (or pre-break scores). In accordance with an exemplary embodiment, the back side of panel 158 is then glued to a back side of the left side panel 140. The right side panel 120 and the front panel 110 are then folded over one another 180 degrees. The left side panel 140 and the back panel 130, and the right side panel 120 and the back panel 130 can then be folded about 90 degrees.

The upper deck flap 154 and the lower deck flap 156 are folded 90 degrees to raise the tray panel 152 upward (or away) from the back panel 130 to a height corresponding to the height of the upper deck flap 154 and the lower deck flap 156, and the width of the inner side deck panel 158 and the outer side deck panel 160. The first upper flap panel 133 and the second lower flap panel 138 are folded 180 degrees inward forming a pair of inner walls of the display box 200 and are configured to receive the pair of outward extending tabs 180, which snap and/or lock into place within the notches 131, 139 on the first upper flap panel 133 and the second lower flap panel 138, respectively. The right upper dust flap 122, the right lower dust flap 124, the left upper dust flap 142 and the left lower dust flap 144 are then folded inward 90 degrees. The upper flap panel 132 and the second lower flap panel 138 are folded 180 degrees over the corresponding right upper dust flap 122, the right lower dust flap 124, the left upper dust flap 142 and the left lower dust flap 144, and then the upper flap panel 132 and the lower flap panel 136 are folded about 90 degrees, which causes the pair of outward extending tabs 180 to snap into place within the notches 131, 139 of the first upper flap panel 133 and the second lower flap panel 138, and causes the blank 100 to take a rectangular box shape thereto. In accordance with an exemplary embodiment, at least one of the first upper flap panel 133 and/or the second lower flap panel 138 includes printing thereon, which reads "PRESS HERE", which provides instructions or guidance for disassembling for recycling.

In accordance with an exemplary embodiment, upon assembly of the display box 200, a foam material 500 (FIG. 5), for example, a polyethylene can be placed between back panel 130 and the tray panel 152. The foam material can include one or more cutouts having the same or a similar shape as the one or more cutouts 170 of the deck panel 150, for example, in the shape of a car charger 172, a battery 174, a USB charger 176, and/or a wall charger 178. In accordance with an exemplary embodiment, the battery and/or accessories (FIG. 6B) preferably fit tightly within the foam material, but can be removed relatively easily for use with an electronic cigarette (not shown).

In accordance with an exemplary embodiment, the only glue and/or adhesive that is used in assembling the display box 200 from blank as shown in FIGS. 1-4 is the gluing of the front flap 112 to an inner or backside surface 111 of the front panel 110.

FIG. 5 is a plan view of a top foam retention panel 510 and a bottom foam retention panel for a display box in accordance with an exemplary embodiment. As shown in FIG. 5, the foam retention block 500 includes two separate panel 510, 520, a first panel (or top panel) 510, and a second panel (or bottom panel) 520. The first panel 510 has one or more cutouts 570, which can be configured, for example, in the shape of a car charger 572, a battery 574, a USB charger 576, and/or a wall charger 578. The second panel 520 also includes one or more cutout 570 preferably in the shape and/or portion of the car charger 572 and the wall charger 578.

In accordance with an exemplary embodiment, the foam retention block 500 is made of a polyurethane foam having a thickness 540, for example, of about 8 to 9 mm ($5/16$ to $11/32$ inch) polyurethane foam. The retention block can have an overall width of about 216 mm (8.504 inches) and height of about 164 mm (6.457 inches). Each of the panels 510, 520 have a width of about 108 mm (4.252 inches) and a height of about 164 mm (6.457 inches).

In accordance with an exemplary embodiment, upon assembly of the display box 200, the foam retention block 500 can be placed between back panel 130, 330 and the tray panel 152, 152. The foam material or foam retention block 500 can include one or more cutouts having the same or a similar shape as the one or more cutouts 170, 170 of the deck panel 150, 150, for example, in the shape of a car charger 172, 172, a battery 174, 174, a USB charger 176, 176, and/or a wall charger 178, 178. In accordance with an exemplary embodiment, the battery and/or accessories (not shown) preferably fit tightly within the foam material, but can be removed relatively easily for use with an electronic cigarette (not shown).

In accordance with an exemplary embodiment, the display box 200 is made of a recyclable material. For example, the display box 200 can be made from a laminar cardboard blank 100, 300 as shown in FIGS. 1-5 and 7-13 that include various panels and flaps, which when folded about appropriate fold lines to form the assembled display box 200. In accordance with an exemplary embodiment, the foam insert can be readily removed before recycling the blank 100, 300 and/or box 200 and the foam material or foam retention block 500.

Figure 6A:
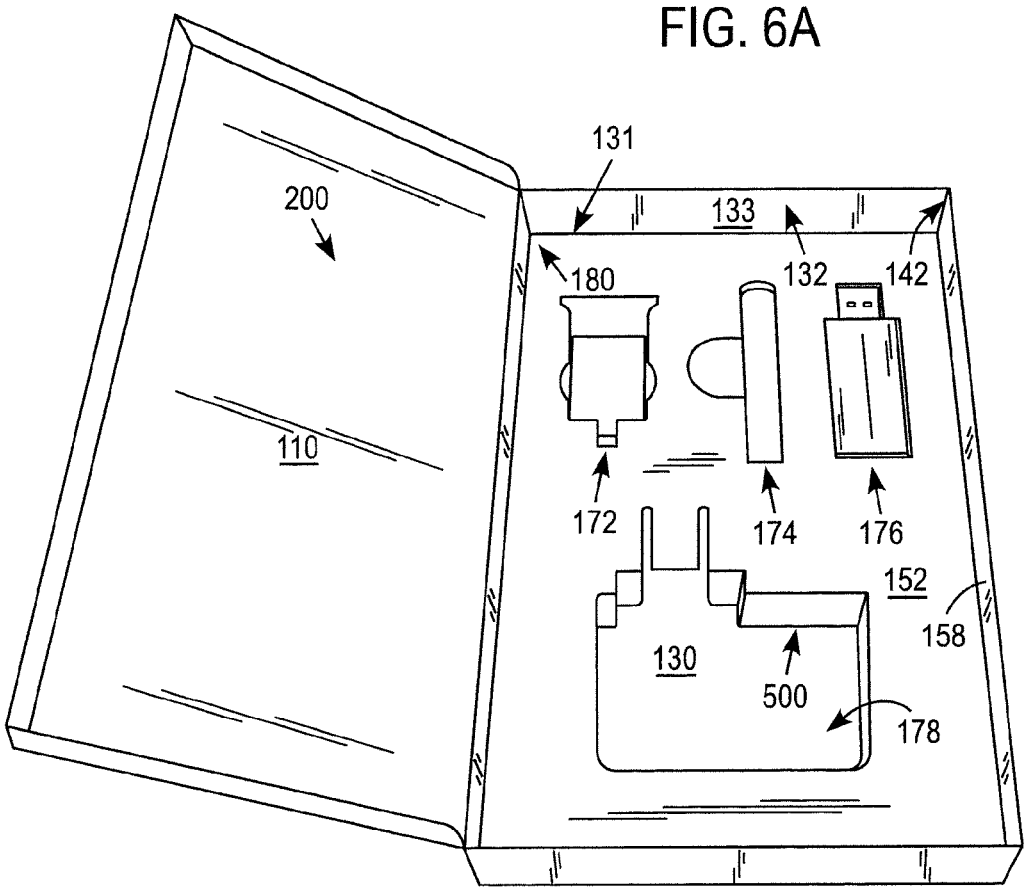
FIG. 6A is a perspective view of the deck panel of the erected display box in accordance with an exemplary embodiment.
Figure 6B:
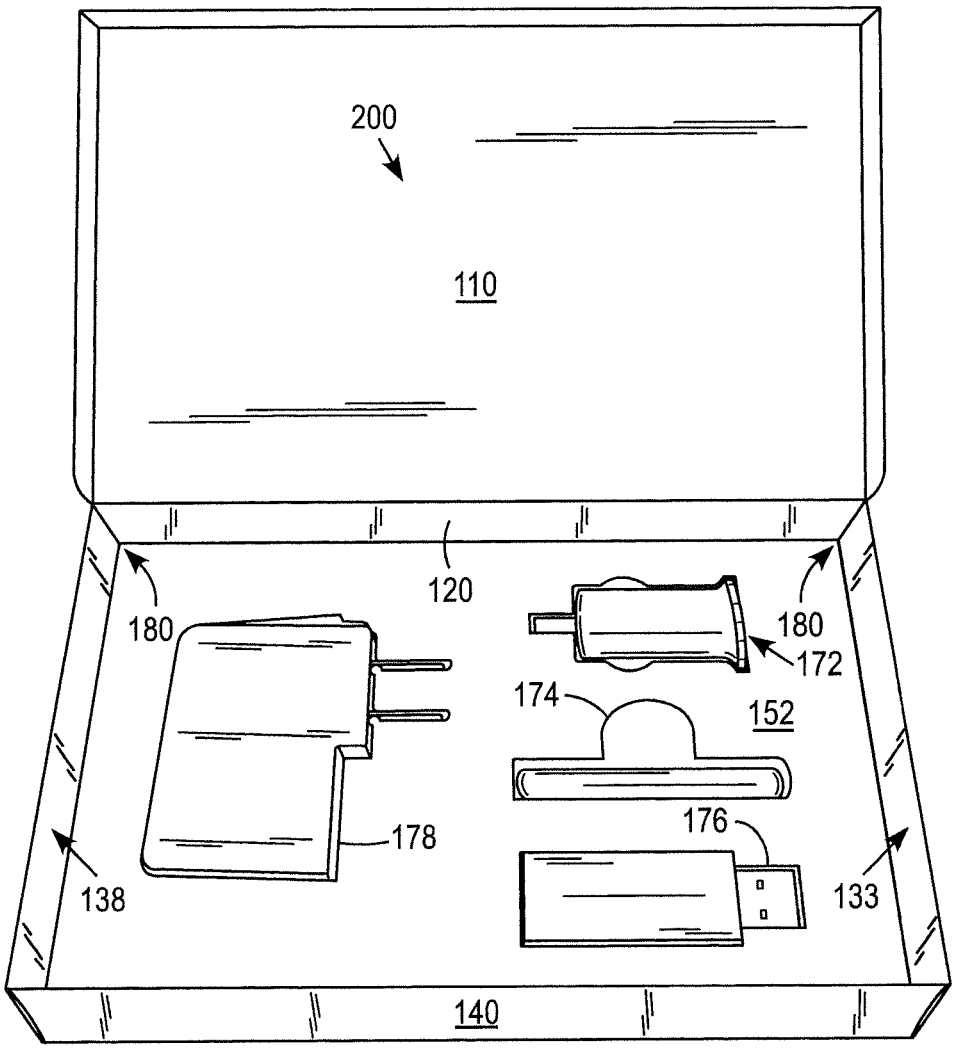
FIG. 6B is a perspective view of the deck panel of the erected display box in accordance with an exemplary embodiment.

FIGS. 6A and 6B are perspective views of the deck panel 150 of the erected display box 200 in accordance with an exemplary embodiment. As shown in FIGS. 6A and 6B, the assembled display box 200 includes a deck panel 150, which includes a tray 152 having one or more cutouts 170, which can be configured, for example, in the shape of a car charger 172, a battery 174, a USB charger 176, and/or a wall charger 178. The tray 152 is positioned forward of the back panel 130 to allow the one or more components (not shown) to fit within the one or more cutouts 170. The left upper dust flap 142, the left lower dust flap 144, the right upper dust flap 122, and the lower right dust flap 124 are folded about 90 degrees. The upper flap panel 132 (the first and second upper panels 133, 134) are folded over and enclose the right upper dust flap 122 and the left upper dust flap 142, whereby the notch 131 of the upper flap panel 133 is disposed adjacent the right side panel 120. Likewise, the lower flap panel 136 (the first and second lower flap panels 137, 138) are folded over and enclose the right lower dust flap 124 and the left lower dust flap 144, whereby the notch 139 of the second lower panel 138 is disposed adjacent to the right side panel 120.

The tray panel 152 is brought into superposed position relative to the back panel 130 by folding the inner side deck panel 158 about 90 degrees (into the page of FIG. 1) into a superposed relation to the bottom panel 140 and folding the tray panel 152 about 90 degrees in the opposite direction. Prior to doing so, the lower and upper deck panels 156 and 154 and the outer side deck panel 160 are folded about 90 degrees (into the page of FIG. 1) such that when the tray panel 152 is brought into place as shown in FIGS. 6A and 6B, edges of those panels contact portions of the back panel 130 to register and support the positioning of the tray panel 152 relative to the back panel 130. As the tray panel 152 is brought into place, the pair of outwardly extending tabs 180 to snap into place within the notches 131, 139 of the first upper flap panel 133 and the second lower flap panel 138, and causes the blank 100 to take a rectangular box shape thereto. In accordance with an exemplary embodiment, the display box 200 is a battery and accessory presentation packaging used in connection with an electronic cigarette. In accordance with an exemplary embodiment, the thickness of the foam determines the height of the tray 152. It is preferred that the lower edges of the deck panels 154, 156, 160 have a slight clearance away from the back panel 130 so that the display panel 152 lies close to the foam insert.

Figure 7:
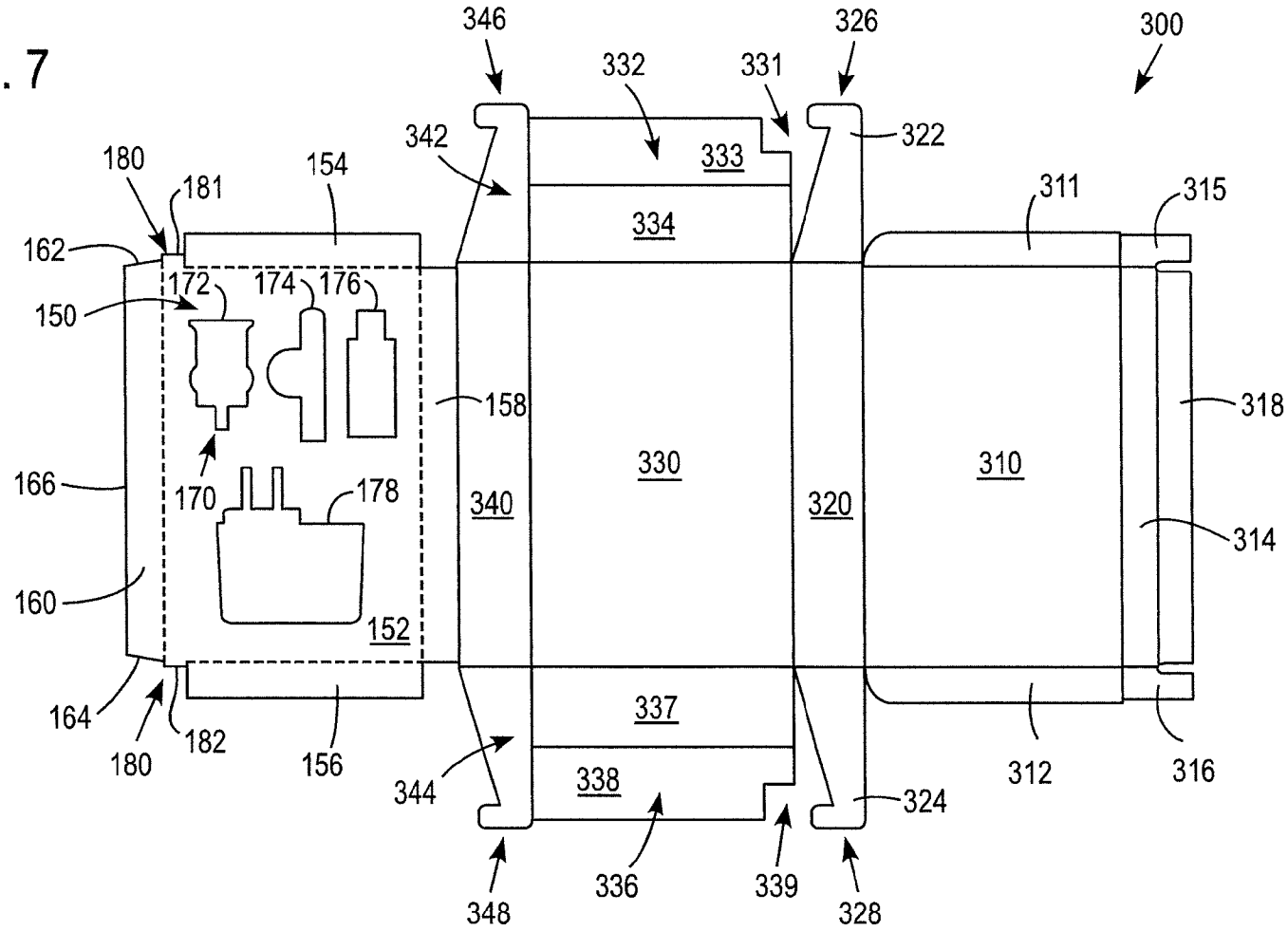
FIG. 7 is a plan view of a blank for a display box in a spread out (unfolded) state in accordance with another exemplary embodiment.

FIG. 7 is a plan view of a blank 300 in a spread out (unfolded) state for a display box 200 in accordance with another exemplary embodiment. The plan view of the blank 300 as shown in FIG. 7 is a view of a bottom side or clay-side of the blank 300. Preferable both sides include clay surfaces, with exception for areas that may be contacted with a glue or adhesive. In accordance with an exemplary embodiment, upon assembly of the blank 300 as shown in FIG. 7, the display box 200 forms a rectangular box or substantially rectangular parallelepipedal in shape, with right-angled longitudinal and right-angled transverse edges.

In accordance with an exemplary embodiment, the blank 300 includes a front panel 310, an right side panel 320, a back panel 330, an left side panel 340, and a deck panel 150. The right side panel 320 is connected along a vertical fold line to the front panel 310. An upper front flap (or panel) 311 and a lower front flap (or panel) 312 are connected along a horizontal fold line to the front panel 310. An outer front panel 314 is connected along a vertical fold line to the front panel 310. An adhesive panel 318 is connected to the outer front panel 314 along a vertical fold line. A pair of upper and lower front dust flaps 315, 316 are connected to the upper front flap 311 and the lower front flap 312, such that they may be tucked in between panels 314 and 318, when panels 311, 314, and 312 are folded about 90 degrees (into the page of FIG. 7) and panel 318 is folded against panel 314. The back panel 330 can have an upper flap panel 332 and a lower flap panel 336 along a horizontal fold line. The back panel 330 is connected along a vertical fold line to the right panel 320. The left side panel 340 is connected along a vertical fold line to the back panel 330. The deck panel 150 is connected along a vertical fold line to the left side panel 340.

In accordance with an exemplary embodiment, the upper flap panel 332 has an upper fold line, which divides the upper flap panel 332 into a first upper flap panel 333 and a second upper flap panel 334. The lower flap panel 336 has a lower fold line, which divides the lower flap panel 336 into a first lower flap panel 337 and a second lower flap panel 338.

In accordance with an exemplary embodiment, a right upper dust flap 322 and a right lower dust flap 324 are each connected along a corresponding horizontal fold line to the right side panel 320. In addition, a left upper dust flap 342 and a left lower dust flap 344 are each connected along a corresponding horizontal fold line to the left side panel 340. The right upper dust flap 322 and the right lower dust flap 324 have a generally rectangular shape extending from the right side panel 320 to a corresponding cross-locking tab 326, 328 on a distal end thereof. The cross-locking tabs 326, 338 on the right upper and lower flap 322, 324, respectively, face the back panel 330. The right upper dust flap 322 and the right lower dust flap 324 are connected along a horizontal fold line to the right side panel 320 having a greater length than the outer horizontal free edge on an outer portion thereof. The left upper dust flap 342 and the left lower dust flap 344 also have a generally rectangular shape extending from the left side panel 340 to a corresponding cross-locking tab 346, 348 on a distal end thereof. The cross-locking tabs 326, 338 on the left upper dust flap 342 and left lower dust flap 344, respectively, face away from the back panel 330. The angled edge of the left upper dust flap 342 and the left lower dust flap 344 are connected along a horizontal fold line to the left side panel 340 having a greater length than the outer horizontal free edge on an outer portion thereof.

In accordance with an exemplary embodiment, upon assembly of the blank 200 into a box structure, the corresponding cross-locking tabs 326, 346 of the upper flaps 322, 342, and the corresponding cross-locking tabs 328, 348 of the lower flaps 324, 344 lock together forming a frictional fit to assist with retaining the blank 300 in maintaining a rectangular or substantially rectangular parallelepipedal shape.

In accordance with an exemplary embodiment, the deck panel 150 has a plurality of fold lines (or scores lines), which divides the deck panel into a tray panel 152, an upper deck flap 154, a lower deck flap 156, an inner side deck panel 158, and an outer side deck panel 160. In accordance with an exemplary embodiment, one or more of the plurality of fold lines (or scores lines), which divides the deck panel into a tray panel 152, an upper deck flap 154, a lower deck flap 156, an inner side deck panel 158, and an outer side deck panel 160 can be perforations, for example, 2.5 by 2.5 perforations. The tray panel 152 can include one or more cutouts 170. In accordance with an exemplary embodiment, the transition from the upper deck flap 154 and the lower deck flap 156 to the outer side deck panel 160 includes a pair of tabs 180, which extend outward from an upper edge 381 and a lower edge 182 of the deck panel 150, respectively. In accordance with an exemplary embodiment, the one or more cutouts 170 can be configured, for example, in the shape of a car charger 172, a battery 174, a USB charger 176, and/or a wall charger 178.

In accordance with an exemplary embodiment, the front panel 310 and the deck panel 150 are printable surfaces. For example, in accordance with an exemplary embodiment, the tray panel 152 of the deck panel can be a printable surface, which identifies corresponding components, which fit within the one or more cutouts 170. In accordance with another exemplary embodiment, the second lower flap panel 338 is a printable surface. For example, the printable surfaces can include a printable clay coat.

In accordance with an exemplary embodiment, the front panel 310 has a height of about 167 mm (6.575 inches) and a width of about 109 mm (inches). The right side panel 320 has a height of about 167 mm (6.575 inches) and a width of about 30 mm (1.181 inches). The back panel 330 has a height of about 167 mm (6.575 inches) and a width of about 110 mm (4.331 inches). The left side panel 340 has a height of about 167 mm (6.575 inches) and a width of about 30 mm (1.181 inches).

In accordance with an exemplary embodiment, the outer front panel 314, which is connected along a vertical fold line to the front panel 310 has a height of about 167 mm (6.575) and a width of about 15 mm (0.591 inches). The right upper dust flap 322 and the right lower dust flap 324 each have a height of about 66.5 mm (2.618 inches) and a width of about 30 mm (3.383 inches). In accordance with an exemplary embodiment, the upper flap panel 342 and the lower flap panel 344 each have a height of about 66.5 mm (2.618 inches) and a width of about 30 mm (3.383 inches). In accordance with an exemplary embodiment, the adhesive panel 318 has a height of about 163 mm (6.417 inches) and a width of about 14 mm (0.551 inches). The upper flap panel 311 and a lower flap panel 312 have a height of about 14 mm (0.551 inches) and width of about 109 mm (4.291 inches). The outer front panel flaps 315, 316 have a height of about 14 mm (0.551 inches) and a width of about 29 mm (1.142 inches).

In accordance with an exemplary embodiment, the upper and the lower front panels 332, 336 each have a height of about 60.5 mm (2.182 inches) and a width of about 110 mm (4.333 inches). The first upper flap panel 333 has a height of about 29.0 mm (3.342 inches) and a width of about 110 mm (4.333 inches). The second upper flap panel 334 has a height of about 30.5 mm (3.203 inches) and a width of about 110 mm (4.331 inches). The first lower flap panel 337 has a height of about 30.5 mm (3.203 inches) and a width of about 110 mm (4.331 inches). The second lower flap panel 338 has a height of about 29.0 mm (3.342 inches) and a width of about 110 mm (4.331 inches). In accordance with an exemplary embodiment, an outer corner of each of the first upper flap panel 333 and the second lower flap panel 338 has a notch (or cut-out) 331, 339 on the outer edge, which is configured to each receive one of the pair of locking edges 180 when the display box is assembled. For example, in accordance with an exemplary embodiment, the notch 331, 339 on the outer edge has a height of about 14.0 mm (0.551 inches) and a width of about 12.0 mm (0.472 inches).

In accordance with an exemplary embodiment, the tray panel 152 has a height of about 194 mm (7.638 inches) and a width of about 109 mm (5.394 inches). The upper deck flap 154 has a height of about 14.0 mm (0.551 inches) to 17.0 mm (0.669 inches) and a width of about 109 mm (4.291 inches). The lower deck flap 156 has a height of about 14.0 mm (0.551 inches) to 17.0 mm (0.669 inches) and a width of about 109 mm (4.291 inches). The inner side deck panel 158 has a height of about 163 mm (6.417 inches) and a width of about 12 mm (0.472 inches) to 15 mm (0.591 inches). The outer side deck panel 160 has a height of about 163 mm (6.417 inches) and a width of about 14 mm (0.551 inches) to 17.0 mm (0.669 inches). In accordance with an exemplary embodiment, a lower edge 162 and an upper edge 164 of the outer side deck panel 160 is angled at about 35 to 60 degrees to a free vertical outer edge 166.

FIG. 8 is a plan view of the blank 300 for a display box as shown in FIG. 7 in a partially folded state in accordance with an exemplary embodiment. As shown in FIG. 8, in accordance with an exemplary embodiment, a pressure sensitive tape 400 (FIG. 9) is applied to a back side of the adhesive panel 318. The deck panel 150 is then folded 180 degrees about the fold line (or pre-break scores) between the deck panel 150 and the left side panel 340. In accordance with an exemplary embodiment, the back side of panel 158 is then glued to a back side of the left side panel 340. The front panel 310 is then folded over 180 degrees onto a backside of the deck panel 150. In accordance with an exemplary embodiment, the manufacturer preferably provides the partially erected blank 300 with the pressure sensitive tape 400 applied to the backside of the adhesive panel 318. The blanks 300 can be stacked into shipping boxes (not shown) for shipping. In accordance with an exemplary embodiment, the blanks 300 are not tightly packed so as to flatten them completely within the shipping box.

In accordance with an exemplary embodiment, the blank 300 can be erected into a box structure as needed. In accordance with an exemplary embodiment, the upper front flap (or panel) 311 and the lower front flap (or panel) 312 connected along a horizontal fold line to the front panel 310, and the outer front panel 314 connected along a vertical fold line to the front panel 310 are folded about 90 degrees inward. The pair of upper and lower front dust flaps 315, 316 are connected to the upper front flap 311 and the lower front flap 312, such that they may be tucked in between panels 314 and 318, when panels 311, 314, and 312 are folded about 90 degrees (into the page of FIG. 7) and panel 318 is folded against panel 314. The adhesive panel 318 is folded about the pair of upper and lower dust flaps 315, 316 and the pressure sensitive tape 400 adheres to the outer front panel 314 to form a front panel assembly.

The left side panel 340 and the back panel 330, and the right side panel 320 and the back panel 330 can then be folded about 90 degrees. The upper deck flap 154 and the lower deck flap 156 are then folded 90 degrees to raise the tray panel 152 upward (or away) from the back panel 330 to a height corresponding to the height of the upper deck flap 154 and the lower deck flap 156, and the width of the inner side deck panel 158 and the outer side deck panel 160. The first upper flap panel 333 and the second lower flap panel 338 are folded 180 degrees inward forming a pair of inner walls of the display box and are configured to receive the pair of outward extending tabs 180, which snap and/or lock into place within the notches 331, 339 on the first upper flap panel 333 and the second lower flap panel 338, respectively. The right upper dust flap 322, the right lower dust flap 324, the left upper dust flap 342 and the left lower dust flap 344 are then folded inward 90 degrees to lock the corresponding locking tabs 326, 346, 328, 348. The upper flap panel 332 and the second lower flap panel 338 are folded 180 degrees over the corresponding right upper dust flap 322, the right lower dust flap 324, the left upper dust flap 342 and the left lower dust flap 344, and then the upper flap panel 332 and the lower flap panel 336 are folded about 90 degrees, which causes the pair of outward extending tabs 180 to snap into place within the notches 331, 339 of the first upper flap panel 333 and the second lower flap panel 338, and causes the blank 300 to take a rectangular box shape thereto.

In accordance with an exemplary embodiment, at least one of the first upper flap panel 333 and/or the second lower flap panel 338 includes printing thereon, which reads "PRESS HERE", which provides instructions or guidance for disassembling for recycling.

FIG. 9 is a plan view of the adhesive panel 318 of the blank 300 for a display box as shown in FIG. 7 in accordance with an exemplary embodiment. FIG. 9 shows a backside or non-coated side of the blank 300. The adhesive panel 318 is connected to the outer front panel 314 along a vertical fold line. In accordance with an exemplary embodiment, the adhesive panel 318 includes an extended line pressure sensitive tape 400. The pressure sensitive tape 400 preferably extends about the length and width of the adhesive panel 318. In accordance with an exemplary embodiment, the pressure sensitive tape 400 is a 3M® Extended Liner Tape 476XL having a ½ inch wide liner and ¼ inch adhesive. Alternatively, in place of the pressure sensitive tape 400, an adhesive can be used, for example, glue spots, glue lines, a glue pattern, a double sided sticker, or other suitable adhesive for assembling the box as described herein.

Figure 10:
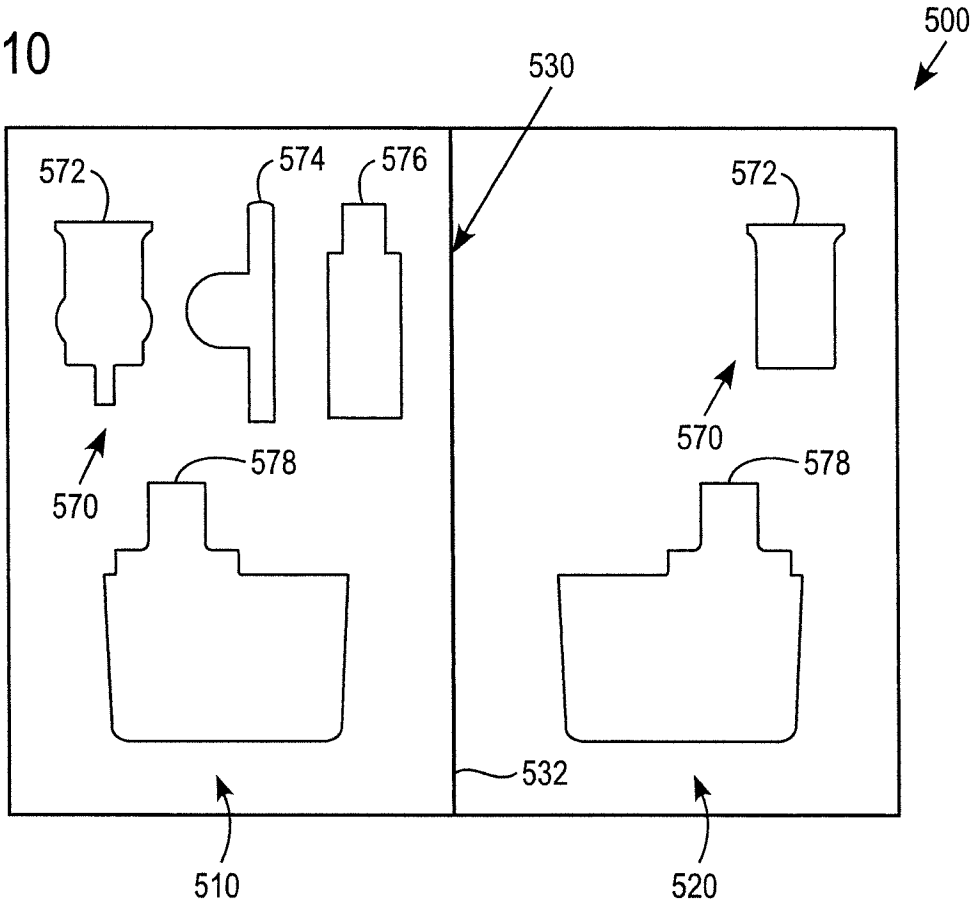
FIG. 10 is a plan view of a foam retention block for a display box as shown in FIG. 6 in accordance with an exemplary embodiment.

FIG. 10 is a plan view of a foam retention block 500 for a display box as shown in accordance with an exemplary embodiment. As shown in FIG. 10, the foam retention block 500 includes a first panel (or top panel) 510, and a second panel (or bottom panel) 520. The first panel 510 has one or more cutouts 570, which can be configured, for example, in the shape of a car charger 572, a battery 574, a USB charger 576, and/or a wall charger 578. The second panel 520 also includes one or more cutout 570 preferably in the shape and/or portion of the car charger 572 and the wall charger 578. A partial cut line 530 separates the first panel 510 from the second panel 520. In accordance with an exemplary embodiment, the partial cut line 530 extends +/− about 95% through the foam retention block 500 so to form a hinge 532.

Figure 11:
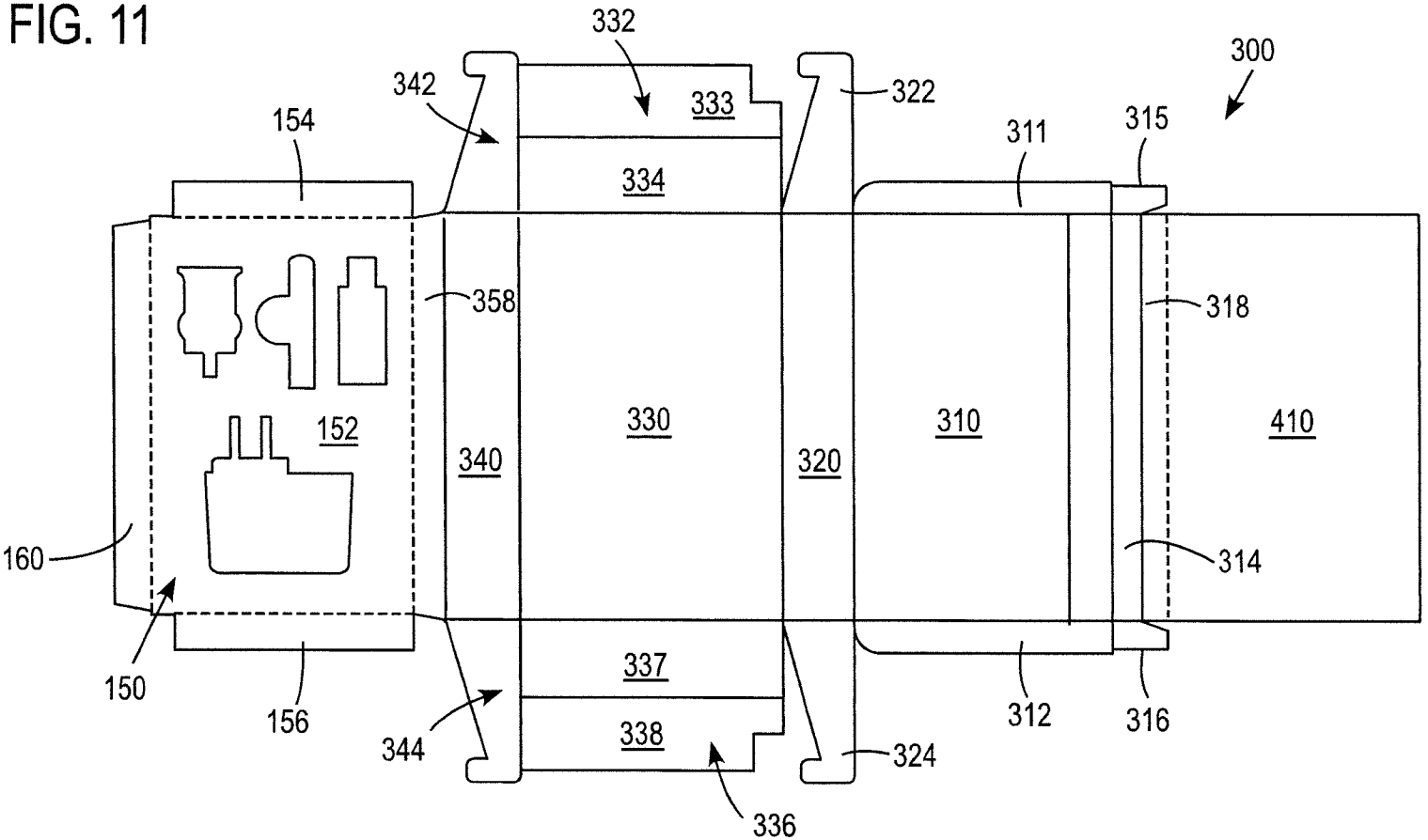
FIG. 11 is a plan view of a bottom side of a blank for a display box in a spread out (unfolded) state in accordance with an exemplary embodiment.

FIG. 11 is a plan view of a blank 300 for a display box in a spread out state in accordance with an exemplary embodiment. The plan view of the blank 300 as shown in FIG. 11 is a view of a bottom side or printable-side (i.e., clay-side), which corresponds to the outside of the box 200. The blank 300 as shown in FIG. 11 is similar to the blank 300 as shown in FIG. 6, and further includes an inner front panel 410 connected along a vertical fold line 420 to the adhesive panel 318. In accordance with an exemplary embodiment, the vertical fold line 420 is a series of perforations, for example, 2.5 by 2.5 perforations. Upon assembly of the blank 300 as shown in FIG. 11, the display box 200 forms a rectangular box or substantially rectangular parallelepipedal in shape, with right-angled longitudinal and right-angled transverse edges. In accordance with an exemplary embodiment, the inner front panel 410 is a generally rectangular panel having a height and width approximately equal to or slightly less than the height and width of the front panel 310.

Figure 12:
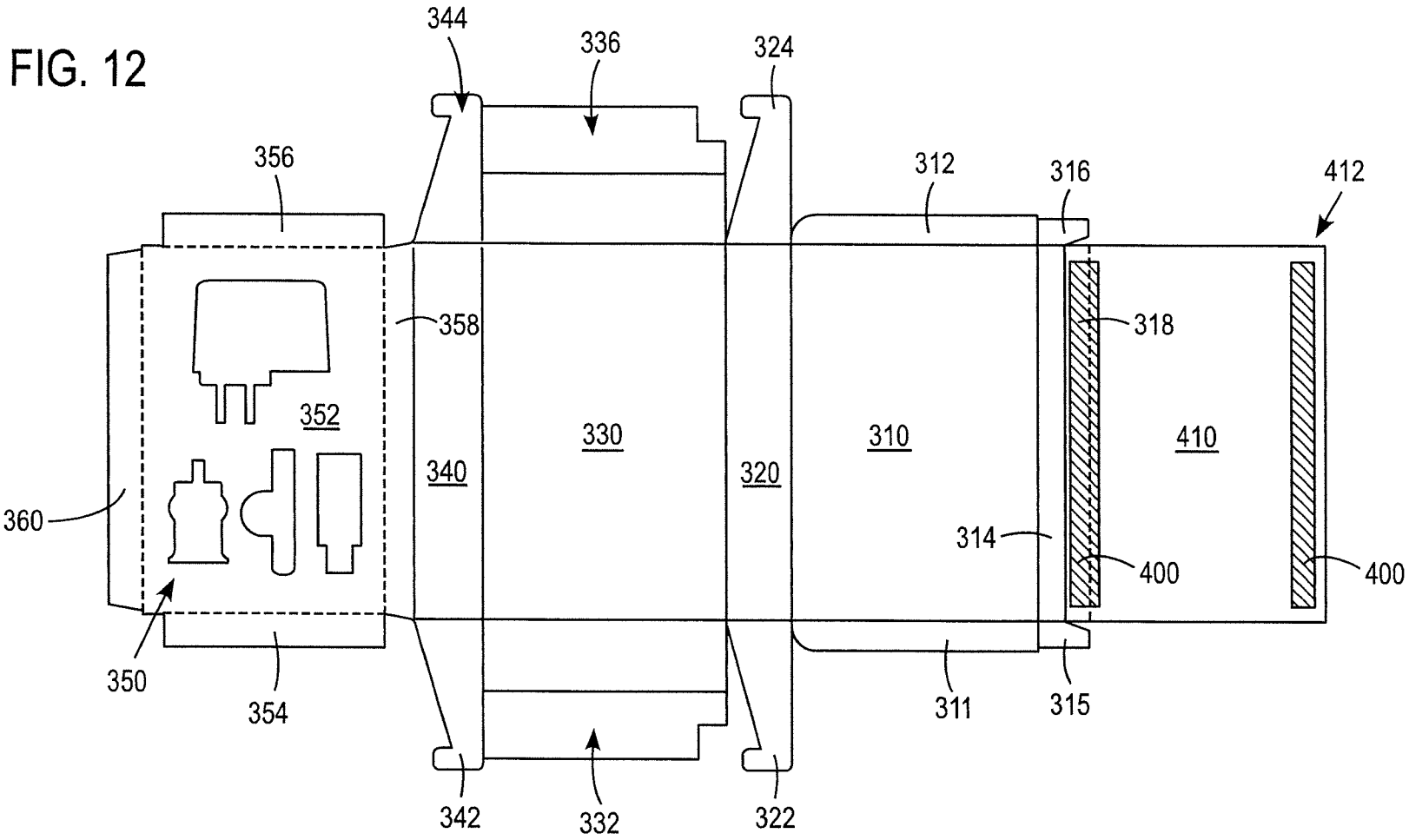
FIG. 12 is a plan view of a top side of the blank as shown in FIG. 11 for a display box in a spread out state in accordance with an exemplary embodiment.

FIG. 12 is a plan view of a top side of the blank as shown in FIG. 11 for a display box in a spread out state in accordance with an exemplary embodiment. In accordance with an exemplary embodiment as shown in FIG. 12, the adhesive panel 318 and an outer most edge 412 of the inner front panel 410 include an extended line pressure sensitive tape 400. The pressure sensitive tape 400 preferably extends about the length and width of the adhesive panel 318 on the adhesive panel 318 and the outer most edge 412 of the front panel 410. In accordance with an exemplary embodiment, for example, the pressure sensitive tape 400 is a 3M® Extended Liner Tape 476XL having a ½ inch wide liner and ¼ inch adhesive. Alternatively, in place of the pressure sensitive tape 400, an adhesive can be used, for example, glue spots, glue lines, a glue pattern, a double sided sticker, or other suitable adhesive for assembling the box as described herein.

In accordance with an exemplary embodiment as shown in FIG. 12, the inner side deck panel 158, the left side panel 340, the front panel 310, the outer front panel 314, the adhesive panel 318 and the inner front panel 410 on the top side of the blank 300 does not include printable surfaces and/or a varnish thereon.

Figure 13:
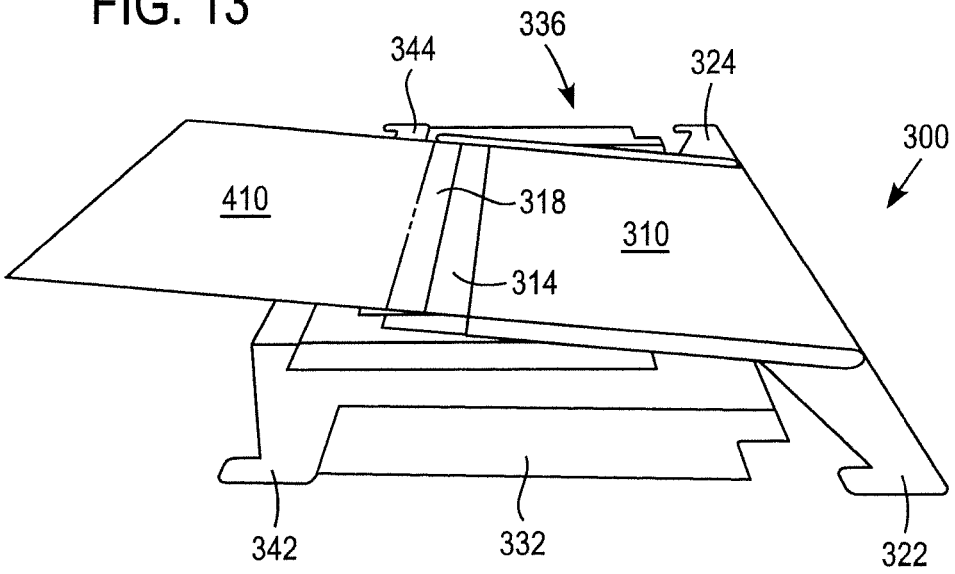
FIG. 13 is a perspective view of the blank for a display box as shown in FIG. 11 in a partially folded state in accordance with an exemplary embodiment.

FIG. 13 is a plan view of the blank for a display box as shown in FIGS. 11 and 12 in a partially folded state in accordance with an exemplary embodiment. As shown in FIG. 13, in accordance with an exemplary embodiment, a pressure sensitive tape 400 (FIG. 12) is applied to a back side of the adhesive panel 318 and an outer most edge 412 of the inner front panel 410. The front panel 150 is then folded 180 degrees about the fold line (or pre-break scores) between the deck panel 150 and the left side panel 340. The back side of panel 158 is then glued to a back side of the left side panel 340. The front panel 310 is then folded over 180 degrees onto a backside of the deck panel 150. In accordance with an exemplary embodiment, the manufacturer preferably provides the partially erected blank 300 with the pressure sensitive tape 400 applied to the backside of the adhesive panel 318 and the outer most edge 412 of the inner front panel 410. The blanks 300 can be stacked into shipping boxes (not shown) for shipping. In accordance with an exemplary embodiment, the blanks 300 are not tightly packed so as to flatten them completely within the shipping box.

In accordance with an exemplary embodiment, the blank 300 can be erected into a box structure as needed. In accordance with an exemplary embodiment, the inner front panel 410 is attached or secured to the front panel 310 using the pressure sensitive tape 400 or adhesive, and folding the inner front panel 410 about 180 degrees onto the front panel 310. In accordance with an exemplary embodiment, the inner front panel 410 provides added rigidity to front panel 310 and provides printable surfaces on both inner front panel 410 and the front panel 310. The upper front flap (or panel) 311 and the lower front flap (or panel) 312 connected along a horizontal fold line to the front panel 310, and the outer front panel 314 connected along a vertical fold line to the front panel 310 are folded about 90 degrees inward. The pair of outer front panel flaps 315, 316 connected to the outer front panel 314 along a horizontal fold line are folded about 90 degrees inward, the adhesive panel 318 is folded about the pair of outer front panel flaps 315, 316 and the pressure sensitive tape 400 adheres to the outer front panel 314 to form a front panel assembly.

The left side panel 340 and the back panel 330, and the right side panel 320 and the back panel 330 can then be folded about 90 degrees. The upper deck flap 154 and the lower deck flap 156 are then folded 90 degrees to raise the tray panel 152 upward (or away) from the back panel 330 to a height corresponding to the height of the upper deck flap 154 and the lower deck flap 156, and the width of the inner side deck panel 158 and the outer side deck panel 160. The first upper flap panel 333 and the second lower flap panel 338 are folded 180 degrees inward forming a pair of inner walls of the display box and are configured to receive the pair of outward extending tabs 180, which snap and/or lock into place within the notches 331, 339 on the first upper flap panel 333 and the second lower flap panel 338, respectively.

The right upper dust flap 322, the right lower dust flap 324, the left upper dust flap 342 and the left lower dust flap 344 are then folded inward 90 degrees to lock the corresponding locking tabs 326, 346, 328, 348. The upper flap panel 332 and the second lower flap panel 338 are folded 180 degrees over the corresponding right upper dust flap 322, the right lower dust flap 324, the left upper dust flap 342 and the left lower dust flap 344, and then the upper flap panel 332 and the lower flap panel 336 are folded about 90 degrees, which causes the pair of outward extending tabs 180 to snap into place within the notches 331, 339 of the first upper flap panel 333 and the second lower flap panel 338, and causes the blank 300 to take a rectangular box shape thereto.

It is to be noted that in the embodiment of FIG. 1, the front panel 110 is reinforced by way of a laminating panel 113 thereon. Only a single outer panel 114 of the front panel 110 tucks into the box structure. In the embodiment of FIG. 7, the top panel (or lid) 310 is given rigidity via the folding of side panels 311, 312, and by securing the dust flaps 314, 316 between panels 314, 318. These panel structure panels 311, 312, 314, and 318 tuck into the box structures. In the embodiment of FIG. 11, the top panel (or lid) 310 is reinforced as in the previous embodiments, but further reinforced with the top laminate of panel 410.

The display box 200 can be produced from the customary materials for cigarette boxes, for example, paper, cardboard, plastic, plastic film or plastic laminate or one of the named materials with an additional metal or metal-oxide coating. Paper or cardboard are preferably used, short-grain paper or short-grain cardboard are particularly preferred as foldable material for the lid portion and the box portion, and also the inner frame. In the case of paper or cardboard production, the product-forming material is placed on a fast-moving belt. In accordance with an exemplary embodiment, the box 200 can be made from a plastic, such as polyethylene.

Alternatively, the display box 200 can include one or more generally rounded longitudinal edges, generally rounded transverse edges, generally beveled longitudinal edges or generally beveled transverse edges, or combinations thereof. For example, by scoring in a known manner a laminar blank 100, 300 from which the box 200 is erected, a box 200 with four generally longitudinally rounded corners, a so called "rounded-corner" box may be produced.

The box 200 can be formed from any suitable materials including, but not limited to, cardboard, paperboard, plastic, metal, or combinations thereof. Preferably, the display box 200 is formed from a folded laminar cardboard blank 100, 300. Preferably, the cardboard has a weight ranging from about 100 grams per square meter to about 150 grams per square meter.

All customary materials may be used as foldable materials for the blanks 100, 300, particularly the papers and cardboards usually used for cigarette boxes, with or without coating, but also plastic materials. The blank 100, 300 may have embossing, printing on the blank in special colors or applying lacquer, metallization, holograms, luminescence or other materials changing the feel, odor or visual appearance of the blank. Additionally, the blank 100, 300 and corresponding display box 200 can be made from a transparent material.

In accordance with an exemplary embodiment, exterior surfaces of the display box 200 may be printed, embossed, debossed or otherwise embellished with manufacturer or brand logos, trademarks, slogans and other consumer information and indicia.

As used herein, the terms "front", "back", "upper", "lower", "side", "top", "bottom" and other terms used to describe relative positions of the components of the blank 100, 300 and/or box 200 according to the disclosure refer to the blank 100, 300 and/or box 200 in an upright position. The terms "left" and "right" are used with reference to side walls of the box 200 when the container is viewed from the front in its upright position.

As used herein, the term "vertical" or "longitudinal" refers to a direction from bottom to top or vice versa of the sleeve. The term "horizontal" or "transverse" refers to a direction perpendicular to the vertical or longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

Although the methods, apparatuses and packaging has been described in terms of the preferred embodiments thereof, it will be appreciated by those skilled in the art that additions, deletions, modifications, and substitutions not specifically described can be made without departing from the spirit and scope of the embodiments as defined in the appended claims.

What is claimed is:

1. A blank for forming a display box, comprising:

a front panel;

a front panel flap connected along a horizontal fold line to the front panel, the front panel flap being configured to adhere to the front panel upon assembly of the display box;

a right side panel connected along a vertical fold line to the front panel;

a back panel having an upper flap panel and a lower flap panel, the upper flap panel having an upper fold line dividing the upper flap panel into a first upper flap panel and a second upper flap panel, the first upper flap panel defining a first notch at a first end of the first upper flap panel that is a closest end to the right side panel, the lower flap panel having a lower fold line dividing the lower flap panel into a first lower flap panel and a second lower flap panel, the second lower flap panel defining a second notch at a first end of the second lower flap panel that is a closest end to the right side panel, a first distance extending from a respective one of the upper and lower fold lines to a bottom surface of a respective one of the first and second notches is less than a second distance extending from the respective one of the upper and lower fold lines to top surface of the respective one of the first and second notches, and the back panel being connected along a vertical fold line to the right side panel;

a left side panel connected along a vertical fold line to the back panel; and a deck panel connected along a vertical fold line to the left side panel, the deck panel having a plurality of fold lines forming a tray panel having at least one cutout, an upper deck flap, a lower deck flap, an inner side deck panel, and an outer side deck panel, the deck panel having a pair of tabs adjacent to ends of the respective upper and lower deck flaps that are the closest ends to the outer side deck panel, the pair of tabs extending outward from an upper edge and a lower edge of the deck panel, respectively, and the pair of tabs being configured to be received within a corresponding one of the first and second notches of the upper flap panel and the lower flap panel upon assembly of the display box.

2. The blank of claim 1, further comprising:

an outer front panel flap connected along a vertical fold line to the front panel.

3. The blank of claim 1, wherein the right side panel has a first upper flap and a first lower flap, the left side panel has a second upper flap and a second lower flap, and the first upper and lower flaps are respectively separated from the second upper and lower flaps.

4. The blank of claim 3, wherein each of the first upper flap and the first lower flap of the right side panel and the second upper flap and the second lower flap of the left side panel has a cross-locking tab on distal end thereof.

5. A blank for forming a display box, comprising:

a front panel;

an outer front panel flap connected along a vertical fold line to the front panel;

an adhesive panel connected along a vertical fold line to the outer front panel flap, an inner front panel connected along a vertical fold line to the adhesive panel, the adhesive panel and an outer most edge of the inner front panel have a pressure sensitive tape on a backside thereof, and the inner front panel being configured to adhere to the front panel upon assembly of the display box;

a right side panel connected along a vertical fold line to the front panel;

a back panel having an upper flap panel and a lower flap panel, the upper flap panel and the lower flap panel each defining a notch on respective ends of the upper and lower flap panels that are the closest ends to the right side panel, and wherein the back panel is connected along a vertical fold line to the right side panel;

an left side panel connected along a vertical fold line to the back panel; and a deck panel connected along a vertical fold line to the left side panel, the deck panel having a plurality of fold lines forming a tray panel having one or more cutouts, an upper deck flap, a lower deck flap, an inner side deck panel, and an outer side deck panel, the deck panel having a pair of tabs adjacent to ends of the respective upper and lower deck flaps that are the closest ends to the outer side deck panel, the pair of tabs extending outward from an upper edge and a lower edge of the deck panel, respectively, and the pair of tabs being configured to be received within the corresponding notches of the upper flap panel and the lower flap panel upon assembly of the box.

6. A self-locking display box configured to receive at least one electrical component, the self-locking display box being erected from a blank including a deck panel having a pair of tabs configured to fit within a corresponding notch of a back panel, the self-locking display box, comprising:

a foam material between an inner surface of the back panel and an inner surface of a tray panel of the blank, the pair of tabs being configured to be received by and to snap into place within the corresponding notch upon assembly of the self-locking display box such that the self-locking display box has a rectangular box shape, the deck panel having an upper deck flap, a lower deck flap, an inner side deck panel, and an outer side deck panel, the upper deck flap including a first tab, of the pair of tabs, the first tab being positioned at an end of the upper deck flap that is the closest end to the outer side deck panel, and the lower deck flap including a second tab, of the pair of tabs, the second tab being positioned at an end of the lower deck flap that is the closest end to the outer side deck panel, the blank further including, a front panel, a front panel flap connected along a horizontal line to the front panel, the front panel flap being configured to adhere to the front panel upon assembly of the display box, a right side panel connected along a vertical fold line to the front panel, the back panel having an upper flap panel and a lower flap panel, the upper flap panel and the lower flap panel each defining the corresponding notch at an end of the respective upper and lower flap panels that are the closest ends to the right side panel, the back panel connected along a vertical fold line to the right side panel.

7. The display box of claim 6, wherein the blank further comprises, a left side panel connected along a vertical fold line to the back panel; and the deck panel is connected along a vertical fold line to the left side panel, the deck panel having a plurality of fold lines forming the tray panel having one or more cutouts, wherein the deck panel has the pair of tabs extending outward from an upper edge and a lower edge of the deck panel, respectively.

8. The box of claim 7, wherein the blank further includes an outer front panel flap connected along a vertical fold line to the front panel, and the front panel flap has an inner surface and an outer surface, the inner surface being attached to an inner surface of the front panel with an adhesive.

9. The box of claim 7, wherein the right side panel has a first upper flap and a first lower flap, the left side panel has a second upper flap and a second lower flap, and the first upper and lower flaps are respectively separated from the second upper and lower flaps.

10. The box of claim 9, wherein each of the first upper flap and the first lower flap of the right side panel and the second upper flap and the second lower flap of the left side panel has a cross-locking tab on distal end thereof.

11. The box of claim 7, wherein the upper flap panel has an upper fold line dividing the upper flap panel into a first upper flap panel and a second upper flap panel.

12. The box of claim 7, wherein the lower flap panel has a lower fold line dividing the lower flap panel into a first lower flap panel and a second lower flap panel.

13. The box of claim 7, wherein the self-locking box has a rectangular parallelepipedal shape, and is constructed of a foldable material.

14. A method of forming a display box, comprising:

providing a blank, the blank including, a front panel, a front panel flap connected along a horizontal fold line to the front panel, the front panel flap being configured to adhere to the front panel upon assembly of the display box, a right side panel connected along a vertical fold line to the front panel, a back panel having an upper flap panel and a lower flap panel, the back panel connected along a vertical fold line to the right side panel, a left side panel connected along a vertical fold line to the back panel, and a deck panel connected along a vertical fold line to the left side panel, the deck panel having a plurality of fold lines forming a tray panel having at least one first cutout, an upper deck flap, a lower deck flap, an inner side deck panel, and an outer side deck panel, and the deck panel having a pair of tabs adjacent to ends of the respective upper and lower deck flaps that are the closest ends to the outer side deck panel, the pair of tabs extending outward from an upper edge and a lower edge of the deck panel, respectively;

attaching the front panel flap to the front panel;

folding the deck panel onto the back panel;

folding the front panel onto the deck panel; and locking into place, the pair of tabs within a first and second notch defined by respective ends of the upper and lower flap panels that are the closest ends to the right side panel, the upper flap panel having an upper fold line dividing the upper flap panel into a first upper flap panel having the first notch and a second upper flap panel, the lower flap panel having a lower fold line dividing the lower flap panel into a first lower flap panel and a second lower flap panel having the second notch, and a first distance extending from a respective one of the upper and lower fold lines to a bottom surface of a respective one of the first and second notches is less than a second distance extending from the respective one of the upper and lower fold lines to top surface of the respective one of the first and second notches.

15. The method of claim 14, wherein the attaching the front panel flap to the front panel includes attaching an inner surface of the front panel flap to an inner surface of the front panel with an adhesive.

16. The method of claim 14, further comprising:

disassembling the display box by pressing on one selected from the upper flap panel and the lower flap panel to collapse the display box.

17. The method of claim 14, further comprising:

placing a foam material between a surface of the back panel and an inner surface of the deck panel, the deck panel having at least one second cutout configured to receive at least one selected from a charger and a battery for an electrical vaping device.

18. A method of forming a display box comprising:

providing a blank, the blank including, a front panel, an outer front panel flap connected along a vertical fold line to the front panel, an adhesive panel connected along a vertical fold line the outer front panel flap, the adhesive panel having a pressure sensitive tape on a backside thereof;

an inner front panel connected to along a vertical fold line to the adhesive panel, the inner front panel being configured to adhere to the front panel upon assembly of the box, a right side panel connected along a vertical fold line to the front panel, a back panel having an upper flap panel and a lower flap panel, the back panel connected along a vertical fold line to the right side panel, a left side panel connected along a vertical fold line to the back panel, and a deck panel connected along a vertical fold line to the left side panel, the deck panel having a plurality of fold lines forming a tray panel having one or more cutouts, an upper deck flap, a lower deck flap, an inner side deck panel, and an outer side deck panel, the deck panel having a pair of tabs adjacent to ends of the respective upper and lower deck flaps that are the closest ends to an outer side deck panel, the pair of tabs extending outward from an upper edge and a lower edge of the deck panel, respectively;

attaching the adhesive panel to the outer front panel flap to form a front panel assembly;

attaching the inner front panel flap to the front panel;

folding the deck panel onto the back panel;

folding the front panel onto the deck panel; and locking into place, each of the pair of tabs within a respective notch defined by an end of the respective upper and lower flap panels of the back panel that are the closest ends to the right side panel.

19. A self-locking display box configured to receive at least one electrical component, the self-locking display box being erected from a blank including a deck panel having a pair of tabs configured to fit within a corresponding notch of a back panel, the self-locking display box, comprising:

a foam material between an inner surface of the back panel and an inner surface of a tray panel of the blank, the pair of tabs being configured to be received by and to snap into place within the corresponding notch upon assembly of the self-locking display box such that the self-locking display box has a rectangular box shape, the tabs being positioned at respective ends of the upper and lower deck flaps that are the closest ends to an outer side deck panel, and the blank further including, a front panel, and an outer front panel flap connected along a vertical fold line to the front panel, an adhesive panel connected along a vertical fold line to the outer front panel flap, an inner front panel connected to along a vertical fold line to the adhesive panel, the inner front panel being configured to adhere to the front panel upon assembly of the box, a right side panel connected along a vertical fold line to the front panel, the back panel having an upper flap panel and a lower flap panel, the upper flap panel and the lower flap panel each defining the corresponding notch at an end of the respective upper and lower flap panels that are closest to the right side panel, the back panel connected along a vertical fold line to the right side panel, the deck panel having a plurality of fold lines forming a tray panel having one or more cutouts, an upper deck flap, a lower deck flap, an inner side deck panel, and the outer side deck panel.

20. The display box of claim 19, wherein the blank further comprises:

a left side panel connected along a vertical fold line to the back panel; and the deck panel is connected along a vertical fold line to the left side panel, the deck panel having the pair of tabs extending outward from an upper edge and a lower edge of the deck panel, respectively.

* * * * *